US005497758A

United States Patent [19]

Dobbins et al.

[11] Patent Number: 5,497,758

[45] Date of Patent: Mar. 12, 1996

[54] COMPRESSED GAS POWERED GUN

[76] Inventors: Jerrold M. Dobbins; Joseph M. Dobbins, both of 9000 S. BlackCat Rd., Nampa, Id. 83687

[21] Appl. No.: 264,368

[22] Filed: Jun. 23, 1994

[51] Int. Cl.[6] ..... F41B 11/06

[52] U.S. Cl. ..... 124/73; 124/71; 124/76

[58] Field of Search ..... 124/73, 74, 75, 124/76, 56, 58, 66–69, 71, 72, 70

[56] References Cited

U.S. PATENT DOCUMENTS

| | | | |
|---|---|---|---|
| 3,763,843 | 10/1973 | Fisher et al. | 124/69 |
| 4,936,282 | 6/1990 | Dobbins et al. | 124/74 |
| 5,078,118 | 1/1992 | Perrone | 124/73 X |
| 5,224,465 | 7/1993 | Milliman | 124/69 X |
| 5,257,614 | 11/1993 | Sullivan | 124/73 |
| 5,265,582 | 11/1993 | Bhogal | 124/73 |
| 5,280,778 | 1/1994 | Kotsiopoulos | 124/73 |
| 5,333,594 | 8/1994 | Robinson | 124/56 X |
| 5,349,938 | 9/1994 | Farrell | 124/72 X |
| 5,349,939 | 9/1994 | Perrone | 124/76 |
| 5,383,442 | 1/1995 | Tippmann | 124/76 |

FOREIGN PATENT DOCUMENTS

| | | | |
|---|---|---|---|
| 1264128 | 1/1990 | Canada | 124/67 |
| 282750 | 9/1990 | Germany | 124/83 |
| 9212395 | 7/1992 | WIPO | 124/56 |

*Primary Examiner*—Eric K. Nicholson
*Assistant Examiner*—Harry C. Kim
*Attorney, Agent, or Firm*—Ken J. Pedersen; Barbara S. Pedersen

[57] ABSTRACT

A compressed gas powered gun having a spring biased slider reciprocally moveable within the breech of the gun; the slider being released by a trigger from a cocked position to a firing position. The slider includes a hammer provided with a roller having a beveled contact surface for engaging a vertically oriented valve stem to release compressed gas from a gas source into the barrel and breech of the gun for propelling a projectile and for recocking the slider, respectively. A gas control system includes an annular partition seal moveable with respect to the slider to create a partition between breech and barrel and a pair of gas release valves communicating respectively with barrel and breech to control pressure within the barrel and breech, hence controlling projectile velocity and recocking force. The valve stem is vertically oriented and perpendicular to the slider and is slightly offset from the longitudinal axis of the slider and operates to rotate the hammer roller to a new striking position to distribute wear on the hammer about the entire circumference of the roller. The position of the valve, being below the breech, helps to alleviate problems associated with liquid-gas mixtures commonly found in carbon dioxide powered guns.

5 Claims, 6 Drawing Sheets

COMPRESSED GAS POWERED GUN

BACKGROUND OF THE INVENTION

1. Field of the Invention

This invention relates, in general, to compressed gas powered guns and more specifically to guns for firing marker projectiles such as "paint balls".

2. Description of the Prior Art

Compressed gas powered guns for the firing of projectiles have long been used. Of more recent use, such guns have been made for the firing of spherical and fragile projectiles containing a colored marking fluid, such projectiles commonly being referred to as "paint balls". Such guns are typified by the inventions of R. G. Shepard, U.S. Pat. No. 4,531,503, showing a pistol which is manually recocked, and D. J. Tippmann, showing a gun which has an automatic recock feature.

Problems with compressed gas powered guns known to be in the art relate to maintenance, complexity, and, in that the compressed gas carbon dioxide, which is commonly used as the propellant, is liquid under the contained pressure, problems also relate to interference of the gas-liquid mixture in the firing mechanism. For cleaning of the breech and barrels, the Tippmann device requires removal of not only the slide or bolt, but also the entire valve assembly, resulting in both loss time and inconvenience. For both the propelling of the projectile and recocking of the slide, guns known to be in the art require two separate valves, one for each function. Further, where valves are in horizontal alignment with the bolt, slide, or hammer, a mixture of liquid and gas propellant may interfere with proper function of the gun. Additionally, in prior art guns, the bolt strikes the valve stem or tip causing wear in a single location on the bolt, also leading to maintenance and function problems.

SUMMARY OF THE INVENTION

These and other problems are eliminated by the gun of the present invention which permits convenient removal of the bolt or slider with removal or interference with the valve system; which contains a sealing partition, slidable along the bolt, thus compartmentalizing the pressure between breech and barrel to obviate the need for a valve for each; which includes a valve stem below and perpendicular to the bolt and breech to decrease gas-liquid propellant interference, in that the liquid settles to the bottom; which provides a novel hammer with roller to distribute wear on the hammer; and which includes simple valves for controlling velocity of the projectile and recocking force of the slider.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
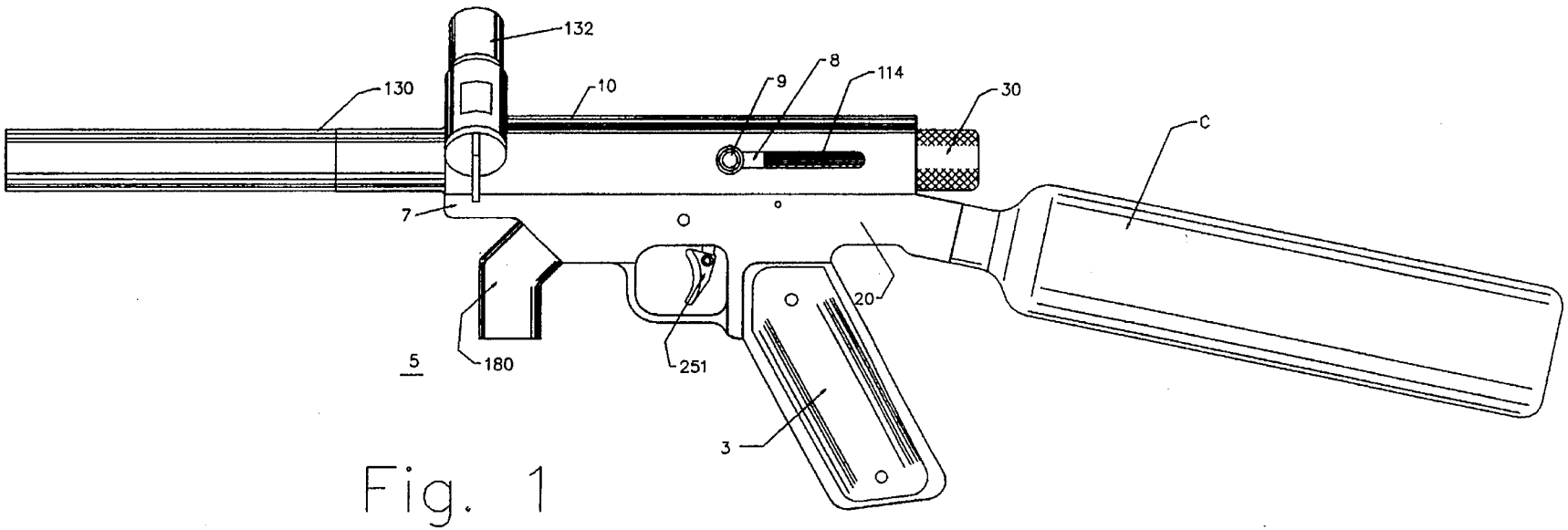
FIG. 1 is a side view of a compressed gas powered gun made according to the present invention.
Figure 2:
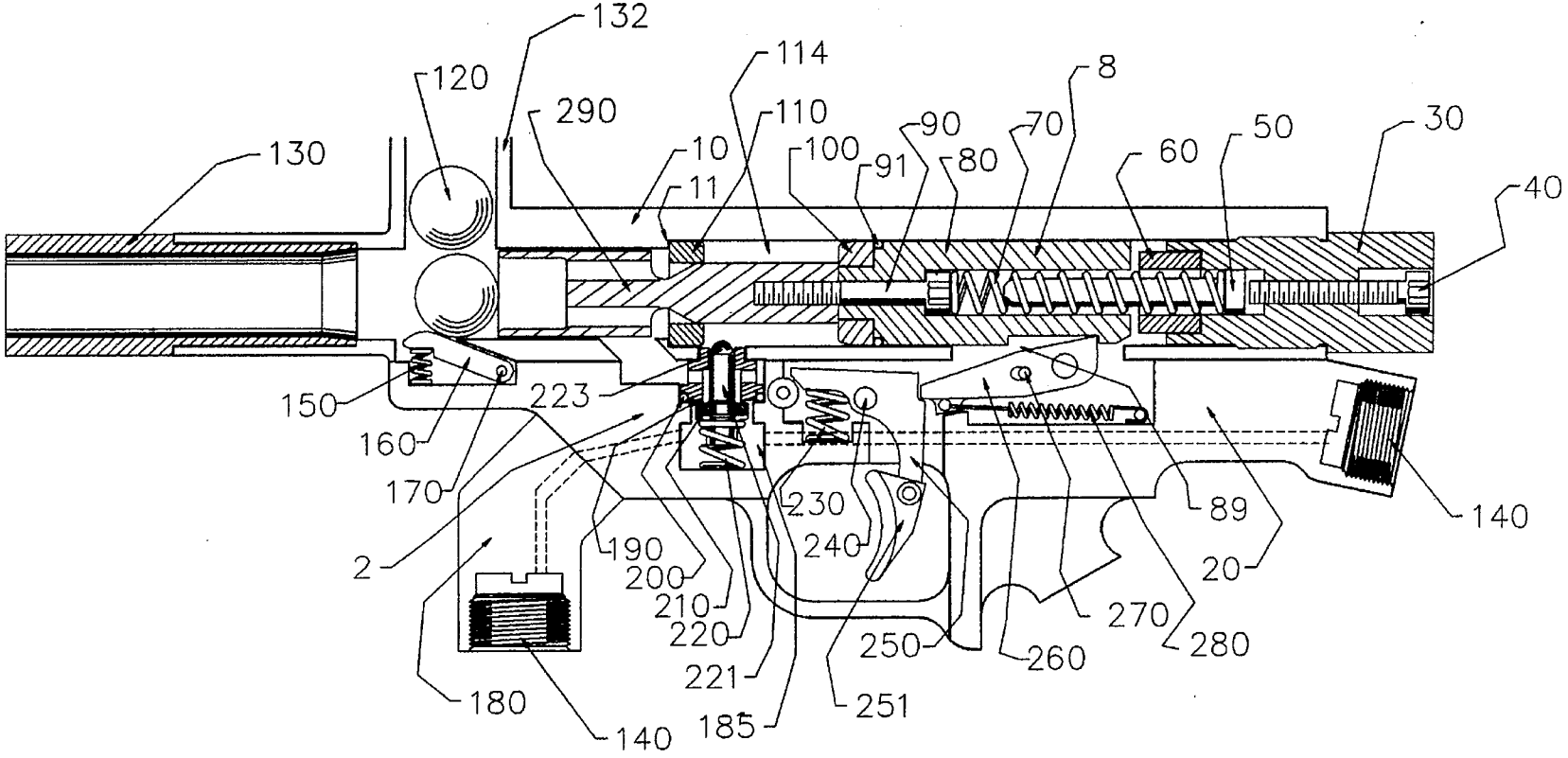
FIG. 2–4 are side views, in cross-section, of the gun of FIG. 1, in partial section, showing sequential operation of the gun.

Referring now to the drawings, and to FIGS. 1 and 2, in particular, an embodiment to be preferred of a compressed gas powered gun 5, made according to the present invention is disclosed. Gun 5 includes, generally, a hand grip or stock 3; a body 7, including an upper main housing 10 and a lower main housing 20; a barrel 130; a breech or hammer chamber 114; a slider 8; and a trigger 251.

Opening into barrel 130 is a projectile feed tube 132 for supplying the barrel with projectiles 120, which are preferably spherical in form and contain a marking fluid, not shown. A ball or projectile retention lever 160, biased by a spring 150 and pivotal about a pin 170 allows only one projectile or ball to enter the barrel at a time.

Figure 6:
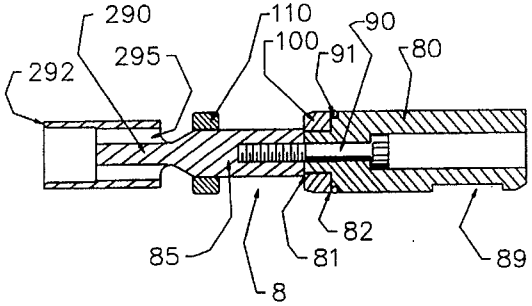
FIG. 6 is a side view, in cross-section, of the slider.

Rearward of barrel 130, breech 114 holds a slider, commonly referred to as a bolt, defined generally by the numeral 8, and shown to advantage in FIG. 6. Slider 8 is horizontally and reciprocally moveable within breech 114 from a cocked position to a firing position. The slider may be manually cocked by means of knob 9, shown in FIG. 1. Slider 8 includes an elongated hammer 80; a bolt tip 290, for engaging a projectile 120; and a shaft 85, circular in cross-section, extending between and connecting the bolt tip to the hammer. Bolt tip 290 is provided with a plurality of gas passages 295 radially spaced about its axis for conducting pressurized gas therethrough. The free terminal end 292 of the bolt tip is chamfered to seat flush with the spherical surface of the projectile.

Defining a portion of hammer 80 is a hammer roller 100, rotatable about the longitudinal axis of the hammer. The roller is held in place on a bushing between shoulder 81 formed on shaft 85 and a shoulder 82 about the forward end of the main body of hammer 80. An O-ring 91 effectively seals the hammer body against the walls of breech 114. A screw 90 affixes the hammer to the shaft. Roller 100 is beveled on its forward end for contact with valve stem tip 223, as will hereinafter be explained.

Figure 7:
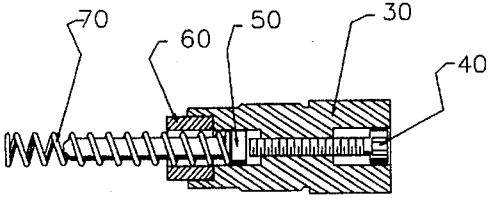
FIG. 7 is a side view, in cross-section, of the end plug, showing the main spring and spring adjustment screw for biasing the slider.

Slider 8 is held within the breech on its forward end by an annular shoulder 11 formed in upper main housing 10 and on the rear end of housing 10 by end plug 30, shown to advantage in FIG. 7. Slider 8 is biased to a firing position by a main compression spring 70 located between the end plug and the slider. Main spring 70 is held within a spring guide 50. An adjustment screw adjusts spring 70 for proper tension and a flexible bumper 60 eases the shock of hammer 80 as it returns to a recocked position.

Releasably holding slider 8 in a cocked position is sear 260 which is pivotal about a pivot pin 270. Sear 260 is held in a cocked position with pawl 265 of the sear engaging a notch 89 on the undersurface of hammer 80. A sear return tension spring 280 returns the sear to the cocked position after being tripped by the trigger. Pulling on trigger 251 pivots trigger arm 250 about trigger pivot pin 240, which in turn pivots sear 260 to release the sear from the notch of the hammer causing the slider to spring forward under the bias of main spring 70. A trigger return spring 230 forces the trigger back to its original position.

Compressed gas, such as carbon dioxide, for propelling projectile 120 and for recocking slider 8 is provided from a canister or cylinder "C", which may be attached directly to gun 5 or may be attached to the person operating the gun. The gas, usually liquified until allowed to expand, is fed through one of the ports 140, two being shown and one of which will be plugged, and then through conduit 183 to a cavity 185 defined by lower main housing 20 of body 7.

Figure 9:
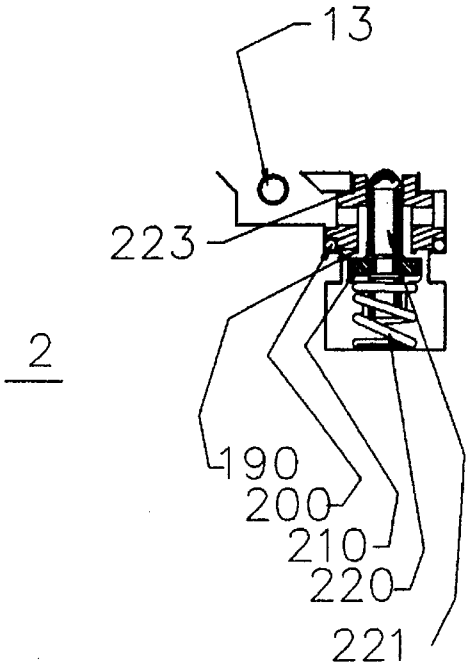
FIG. 9 is a sectional view of the valve, shown in the open, gas releasing position.
Figure 8:
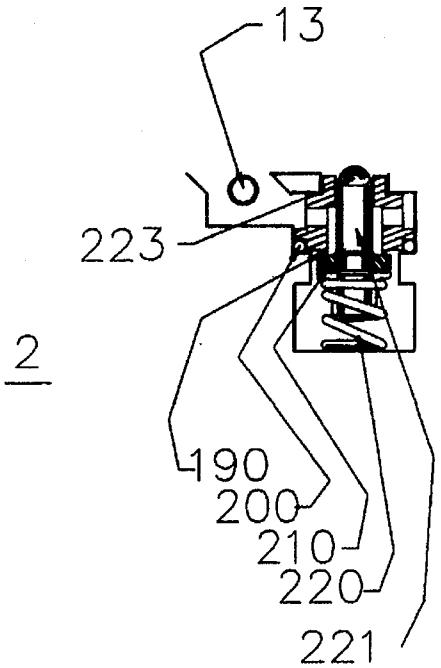
FIG. 8 is a sectional view of the valve shown in FIG. 2, shown in the closed position.

Contained within cavity 185 is valve means, designated generally by the numeral 2 and shown to advantage in FIGS. 8 & 9. Valve means 2 includes a vertically oriented valve stem 221 which is vertically and reciprocally moveable within a valve stem guide 215. Valve stem 221 is provided with a base portion 210 which engages a valve compression spring 220, biasing the valve stem upwardly to a seated position on seat 190 of the stem guide to prevent flow of compressed gas from cavity 185. A valve seat O-ring 200 provides a seal between the valve stem guide and the breech and barrel to prevent gas escaping into the breech and barrel when the valve is properly seated.

Once slider 8 is released from its cocked position to the firing position, the beveled edge of roller 100 of hammer 80 of the slider engages the tip 223 of valve stem 221 forcing the stem downwardly against the bias of spring 220, causing gas to flow into both the barrel and the breech.

Figure 5:
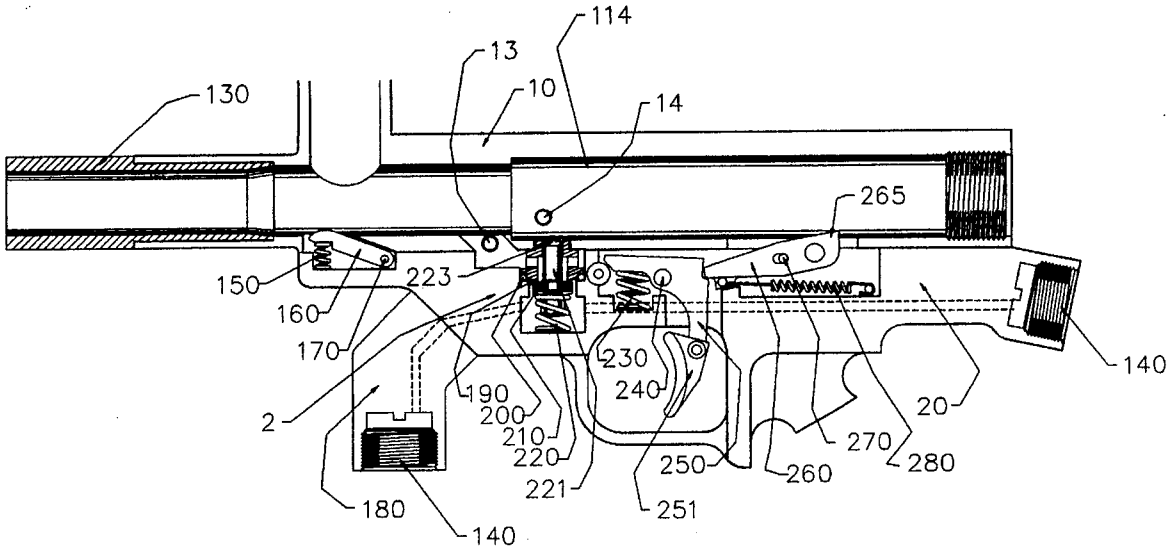
FIG. 5 is a side view, in cross-section, of the gun of FIG. 1, shown without the slider for clarity.

For controlling the gas exiting from cavity 185 to the breech and barrel, and hence for controlling the velocity of the projectile propelled from the barrel and for controlling the force of recocking slider 8, novel gas control means are provided. The gas control means include an annular gas partition sealant sleeve 110 mounted on shaft 85 of slider 8. Sleeve 110 is operable to form a sealed partition between the barrel and breech and yet allow for reciprocal movement of slider 8 to which it is mounted. Sleeve 110 is held in position by shoulder 11 and by valve stem tip 223, which projects upwardly into the breech when not contacted by roller 100. The gas control means also includes a first gas release valve 13 communicating between the barrel and the exterior of the gun and a second gas release valve 14 communicating between the breech and the exterior of the gun, see FIG. 5. Each of the release valves, 13 and 14, include a threaded aperture provided with a mating screw, not shown. By rotation of the screw within the aperture, a selected volume of gas is allowed to escape to atmosphere, thus controlling the pressure within the barrel to regulate the velocity at which projectile 120 is propelled and controlling the pressure within the breech and against hammer 80 to regulate the force and speed of recocking of the slider.

Figure 3:
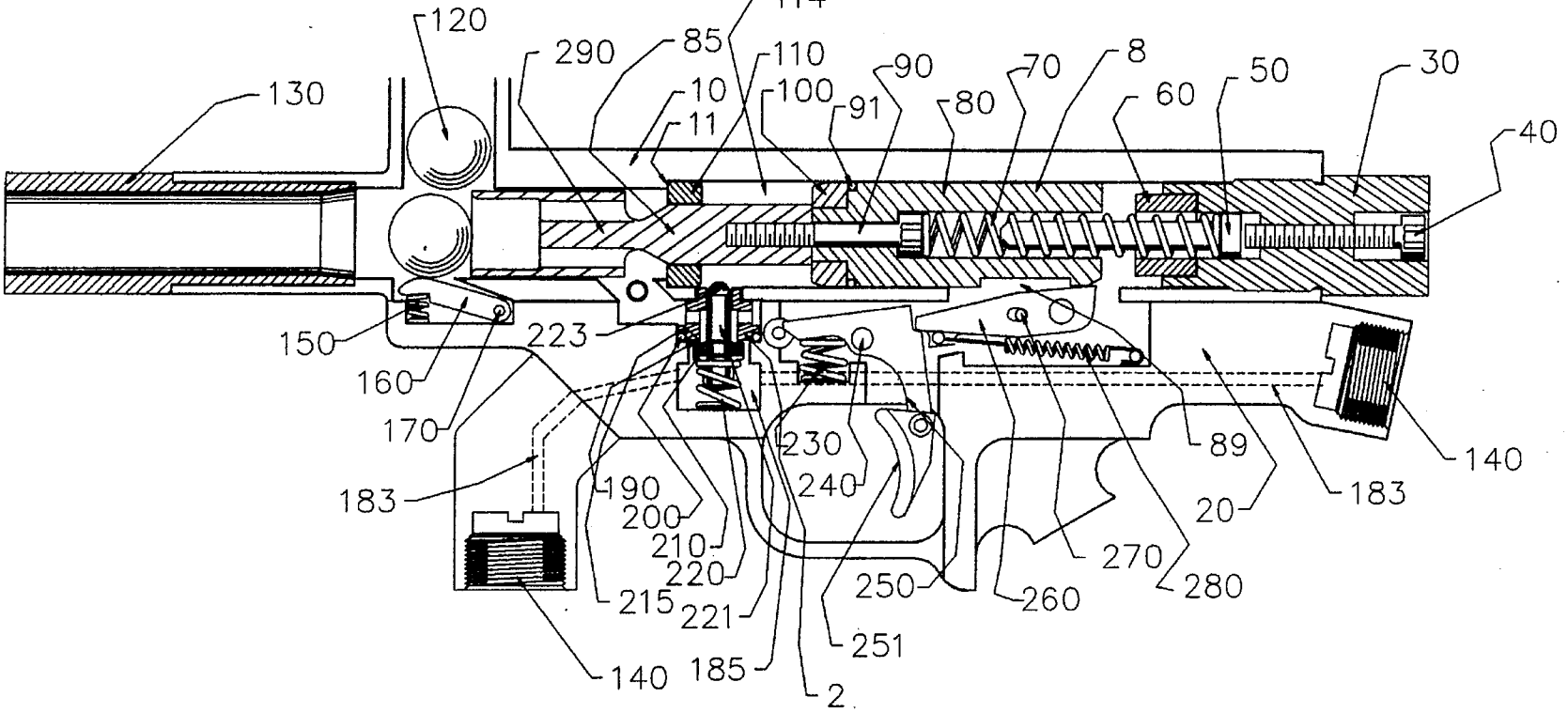
Figure 4:
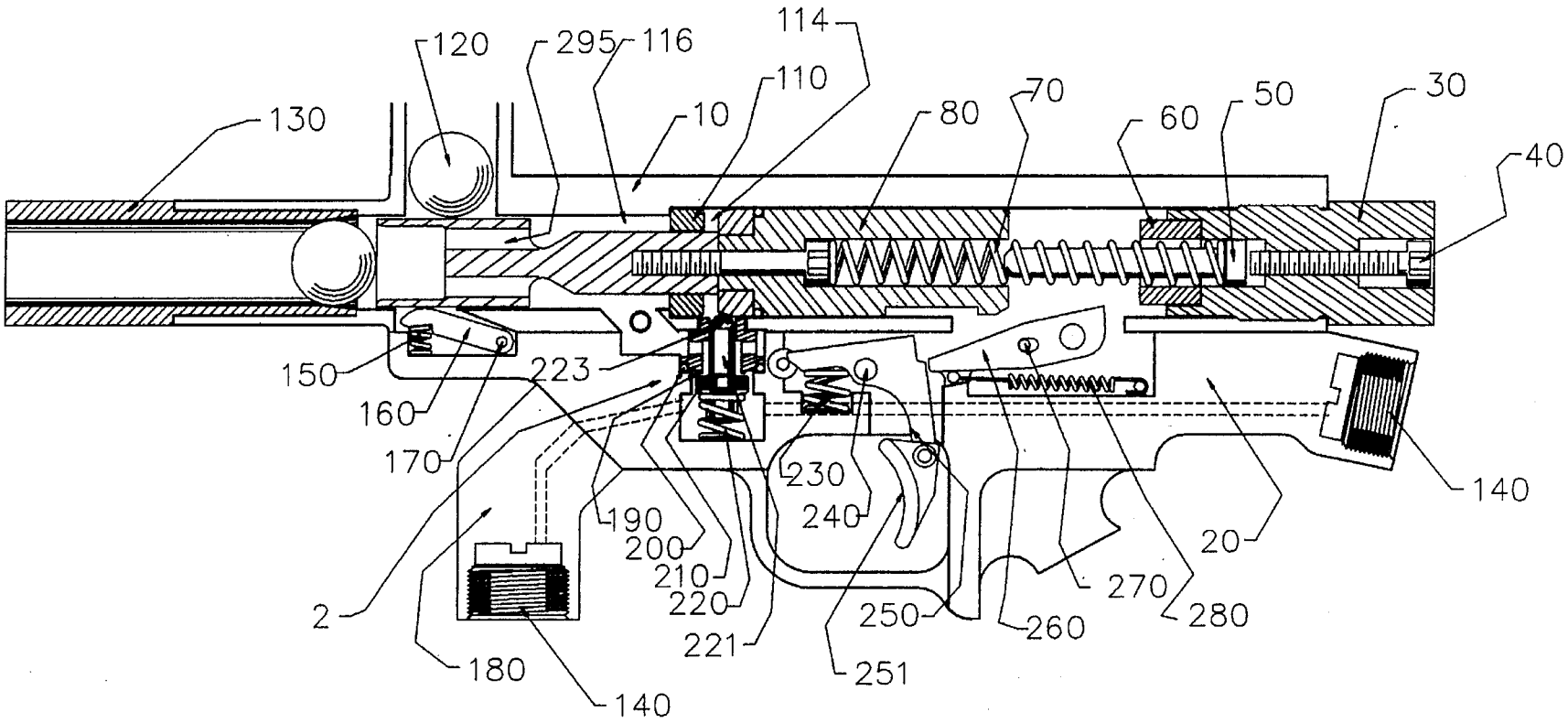

Referring now to FIGS. 2,3, and 4, sequential action of gun 5 may be seen to advantage. As shown in FIG. 2, a projectile, ball 120 is in place upon ball retention lever 160 and within barrel 130. A second ball is held in place above the barrel and within feed tube 132 by the first ball. Slider 8 is in the cocked position under tension of main spring 70 and partition sleeve 110 is held in position between shoulder 11 of the upper housing 10 and tip 223 of valve stem 221. It is assumed that one port 140 has been plugged and the remaining port is in fluid communication with compressed gas source "C" to fill cavity 185 with compressed gas, which may be liquified.

Referring to FIG. 3, trigger 251 has been pulled, forcing sear 260 to pivot about pin 270 to release the sear from notch 89 of hammer 80. Under bias of main spring 70, slider 8 moves forward with shaft 85 slidably engaging partition sleeve 110. Bolt tip 290 of slider 8 engages the first projectile 120 moving it forwardly and sealing it against the tip. Valve means 2 has not yet been actuated to release compressed gas.

Referring to FIG. 4, it will be seen that roller 100, on its beveled surface, has engaged tip 223 of valve stem 221. Valve stem 221 is laterally offset from the axis about which the roller rotates, causing the roller to rotate to a new striking position upon its contact with the tip. It will be seen, then, that the entire beveled surface of the roller is usable to spread the wear about the entire circumference of the beveled surface of the roller. Simultaneously, stem 221 is forced downwardly against the bias of valve return spring 220 to unseat the valve stem from its seat, thus allowing the compressed gas to enter both barrel 30 and breech 114 on opposing sides of partition sleeve 110. Gas entering the barrel progresses through passages 295 of bolt tip 290 of sleeve 8 forcing first spherical ball 120, which has a diameter approximating that of the bore of the barrel, out of the barrel at a velocity dependent upon the gas pressure within the barrel which if controlled by release valve 13 (See FIG. 5). Gas entering the breech 114, being compressed between partition sealing sleeve 110 and hammer 80, forces the hammer and hence slider 8 back to the recocked position shown in FIG. 2. Tension spring 280 cause sear 260 to again engage notch 89 of hammer 80 to hold the slider in the cocked position. Valve stem 221 is again biased into its seated position by valve return spring 220 to prevent further flow of compressed gas, and ball retention lever 160 again holds a ball in place under bias of spring 150.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. A compressed gas powered gun comprising:

a gun body provided with a barrel and a breech;

a spring biased slider horizontally and reciprocally moveable within said breech between a cocked position and a fired position;

a trigger for releasably holding said slider in said cocked position;

a compressed gas source;

a valve means actuated by said slider for releasing pressurized gas from said gas source independently to the barrel for propelling a projectile and to the breech for recocking said slider; and a gas control means for controlling gas pressure to the barrel for propelling said projectile at a selected velocity and to the breech for recocking the slider under a selected pressure, wherein said control means comprises:

an annular gas partition sleeve slidably received on said slider for partitioning gas between the breech and the barrel;

a velocity gas release valve communicating with the barrel; and a recock gas release valve communicating with the breech.

2. The gun as described in claim 1, wherein said valve means includes a valve stem guide and a valve stem vertically and reciprocally moveable within said guide; said stem engageable with said slider for releasing pressurized gas from said gas source.

3. The gun as described in claim 2, wherein said slider includes an elongated hammer, said hammer provided with a roller rotatable about the longitudinal axis of the hammer, said roller having a beveled surface about its circumference for striking said valve stem to open said valve means for release of pressurized gas from said gas source and to simultaneously rotate said roller to a new strike position to distribute wear about the circumference of said roller.

4. A compressed gas powered gun comprising:

a gun body provided with a barrel and a breech;

a spring biased slider horizontally and reciprocally moveable with said breech between a cocked position and a fired position, said slider provided with an elongated hammer; a projectile engaging tip; and a shaft extending between and connecting said hammer and said tip;

a trigger for releasably holding said slider in said cocked position;

a compressed gas source;

valve means including a vertically reciprocating valve stem engageable by said hammer for releasing pressurized gas from said gas source to the barrel and breech for propelling a projectile and for recocking said slider, respectively; and control means for controlling gas pressure within said barrel and said breech, said control means including an annular gas partition sleeve slidably received on said slider shaft for partitioning gas between the breech and the barrel; a velocity gas release valve communicating with the barrel for controlling gas pressure within the barrel and hence for controlling the velocity of a projectile; and a recock gas release valve communicating with the barrel for controlling gas pressure within the breech and hence for controlling recocking pressure.

5. The gun as described in claim 4 wherein said hammer of said slider is provided with a roller having a beveled surface about its circumference, said roller rotatable about the longitudinal axis of said hammer, and said beveled surface of the roller engageable with the valve stem for rotating said roller to a new strike position for reducing wear on said roller.

* * * * *